US011659934B2

(12) United States Patent
Edmondson et al.

(10) Patent No.: US 11,659,934 B2
(45) Date of Patent: May 30, 2023

(54) MODULAR FURNITURE SYSTEM WITH SHARED SUPPORT AND METHOD THEREFOR

(71) Applicant: NEIGHBOR, Phoenix, AZ (US)

(72) Inventors: Joel Edmondson, Phoenix, AZ (US); Nicholas R. Arambula, Phoenix, AZ (US); Michael D. Fretto, Phoenix, AZ (US); Christopher R. Lee, Phoenix, AZ (US)

(73) Assignee: Neighbor, Phoenix, AZ (US)

( * ) Notice: Subject to any disclaimer, the term of this patent is extended or adjusted under 35 U.S.C. 154(b) by 0 days.

(21) Appl. No.: 17/546,883

(22) Filed: Dec. 9, 2021

(65) Prior Publication Data

US 2022/0192385 A1 Jun. 23, 2022

Related U.S. Application Data

(60) Provisional application No. 63/126,607, filed on Dec. 17, 2020.

(51) Int. Cl.
*A47C 13/00* (2006.01)

(52) U.S. Cl.
CPC ..... *A47C 13/005* (2013.01)

(58) Field of Classification Search
CPC ..... A47C 13/005
USPC ..... 297/64
See application file for complete search history.

(56) References Cited

U.S. PATENT DOCUMENTS

| | | | | |
|---|---|---|---|---|
| 3,328,075 | A | 6/1967 | Albinson | |
| 3,584,916 | A | 6/1971 | Selden | |
| 4,043,591 | A | 8/1977 | Lehmann | |
| 7,020,911 | B2 | 4/2006 | Oldham | |
| 8,833,271 | B2 | 9/2014 | Everett | |
| 2005/0272525 | A1 | 12/2005 | Nakahara et al. | |
| 2017/0071354 | A1* | 3/2017 | Mezzera | A47C 4/028 |
| 2018/0271294 | A1* | 9/2018 | Chiriac | A47C 11/005 |
| 2020/0187654 | A1 | 6/2020 | Mutyala | |

(Continued)

FOREIGN PATENT DOCUMENTS

| | | |
|---|---|---|
| CN | 212938961 | 4/2021 |
| EP | 3292793 | 11/2018 |

(Continued)

OTHER PUBLICATIONS

The Sectional Modern Teak Outdoor Sectional Source: https://www.hineighbor.com/products/the-sectional Date Accessed: Sep. 10, 2021.

*Primary Examiner* — Mark R Wendell
(74) *Attorney, Agent, or Firm* — Jeffrey D. Moy; Weiss & Moy, PC

(57) ABSTRACT

A modular furniture has a first modular furniture unit. The first modular unit has a first frame. A pair of front legs is attached to the first frame, wherein a first of the pair of front legs supports and holds one of a first adjacent modular furniture unit or a first arm rest and a second of the pair of front legs supports and holds one of a second adjacent modular furniture unit or a first arm rest. A pair of rear legs is coupled to the first frame, wherein a first of the pair of rear legs supports and holds one of the first adjacent modular furniture unit or the first arm rest and a second of the pair of rear legs supports and holds one of the second adjacent modular furniture unit or the second arm rest.

13 Claims, 4 Drawing Sheets

(56) References Cited

U.S. PATENT DOCUMENTS

| | | | | |
|---|---|---|---|---|
| 2021/0196049 | A1* | 7/2021 | McCreary | A47C 17/04 |
| 2021/0251387 | A1* | 8/2021 | Milberg | A47C 13/005 |

FOREIGN PATENT DOCUMENTS

| | | |
|---|---|---|
| WO | 2017131521 | 8/2017 |
| WO | 2021042180 | 3/2021 |
| WO | 2021092642 | 5/2021 |

* cited by examiner

MODULAR FURNITURE SYSTEM WITH SHARED SUPPORT AND METHOD THEREFOR

RELATED APPLCIATIONS

This patent application is related to U.S. Provisional Application No. 62/126,607 filed Dec. 17, 2020, entitled "MODULAR FURITURE SYSTEM WITH SHARED SUPPORT AND METHOD THEREFOR" in the name of the same inventors, and which is incorporated herein by reference in its entirety. The present patent application claims the benefit under 35 U.S.C § 119(e).

TECHNICAL FIELD

The present application generally relates to furniture and, more particularly, to a modular furniture system which uses a shared support between modules to provide increased stability.

BACKGROUND

Modular furniture may be defined as pre-made or ready-made furniture which can be used according to the need and spacing requirements. Modular furniture can be independently created and then used in different arrangements/configurations. A modular system can be characterized by functional partitioning into discrete scalable, reusable modules which may use industry standards for interfaces.

In the outdoor furniture industry, the terminology, "modular furniture," may be used when marketing individual furniture components (i.e., modules) that may require the user to combine for the purposes of laying out a larger furniture configuration. The larger furniture configurations may require the user to "pushed together" different modules which expose seams between the adjacent modules. Further, depending on how they are constructed, pushing together different modules may cause potential stability issues. For example, moving from one module to another may cause the modules to separate and move away from one another.

Audiences who desire a more unified functionality, that avoids the above issues, while maintaining a clean design sensibility akin to indoor furniture do not have many options to remedy the above problem. Common solutions to the above problem may be to combine and secure the individual modules together using clamps or other fasteners. While these fasteners may work, they are unaesthetically pleasing to the end user.

Therefore, it would be desirable to provide a system and method that overcome the above problems.

SUMMARY

In accordance with one embodiment, a modular furniture system is disclosed. The modular furniture system has a first modular furniture unit. The first modular furniture unit has a first frame. A pair of front legs is attached to the first frame, wherein a first of the pair of front legs supports and holds one of a first adjacent modular furniture unit or a first arm rest and a second of the pair of front legs supports and holds one of a second adjacent modular furniture unit or a second arm rest. A pair of rear legs is coupled to the first frame, wherein a first of the pair of rear legs supports and holds one of the first adjacent modular furniture unit or the first arm rest and a second of the pair of rear legs supports and holds one of the second adjacent modular furniture unit or the second arm rest.

In accordance with one embodiment, a modular furniture system is disclosed. The modular furniture system has a first modular furniture unit. The first modular furniture unit has a first frame. A first front leg is attached to the first frame. A second front leg attached to the first frame. A first rear leg is attached to the first frame. A second rear leg is attached to the first frame. A second modular furniture unit is provided. The second modular furniture unit has a second frame. A third front leg is attached to the second frame. A third rear leg is attached to the second frame. The second front leg and the second rear leg are both attached to the second frame and support and hold both the first frame and the second frame.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figure 1:
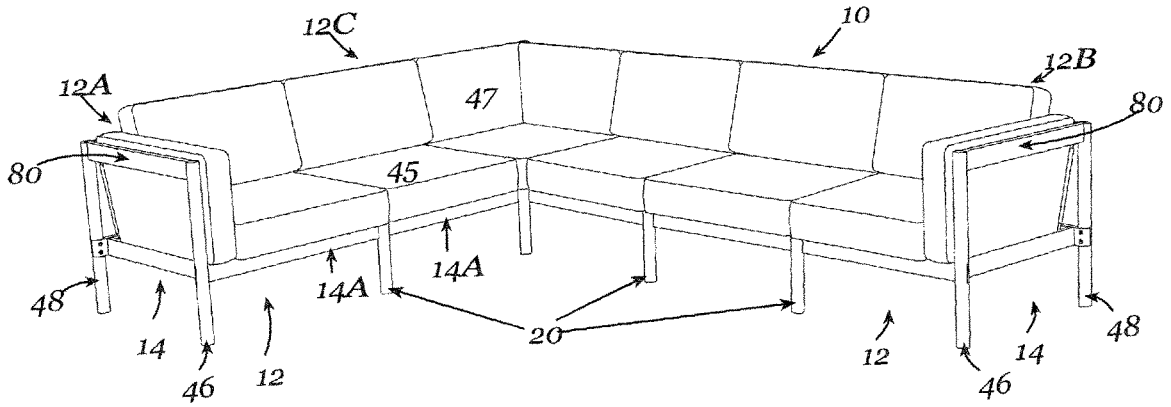
FIG. 1 is a front perspective view of an exemplary embodiment of a module furniture system in accordance with one embodiment of the present invention.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Embodiments of the exemplary modular furniture provides a modular furniture system which may be formed into a plurality of different configurations wherein adjacent modules share at least one common leg.

Referring now to the FIGS. 1-6, a modular furniture system being formed into an "L" shaped couch 10 may be disclosed. The "L" shaped couch 10 may be formed of a plurality of modules 12. Each module 12 may be formed of a frame 14. The frame 14 may be formed of a front support member 14A, a rear support member 14B, and a pair of side support members 14C and 14D positioned on opposing sides of the frame 14. The front support member 14A may have one or more holes 16 formed through each side end (i.e., left-side end and the right-side end) of the front support member 14A as may be seen in FIG. 3. In accordance with one embodiment, a pair of holes 16 may be formed through each side end (i.e., left-side end and the right-side end) of the front support member 14A. The pair of holes 16 maybe aligned vertically on each side end (i.e., left-side end and the right-side end) of the front support member 14A.

One of the pair of side support members 14C and 14D may be coupled to each side end (i.e., left-side end and the right-side end) of the front support member 14A. In accordance with one embodiment, each of the pair of side support members 14C and 14D may attached to the front support member 14A inside of where the holes 16 may be formed.

Figure 5:
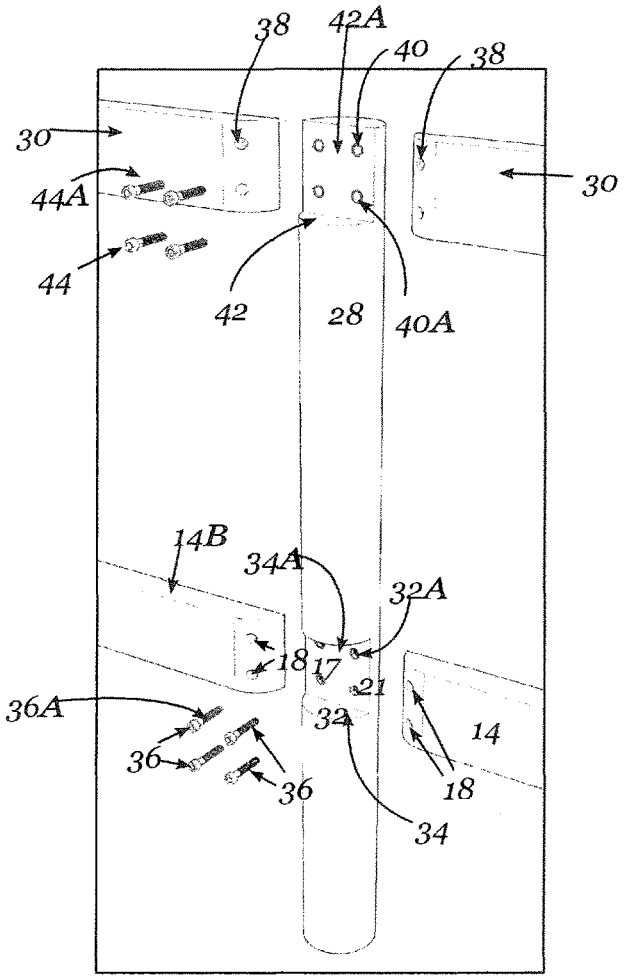
FIG. 5 is a magnified exploded perspective view of an exemplary embodiment of a shared common rear leg of the module furniture system of FIG. 1 in accordance with one embodiment of the present invention.

The rear support member 14B may have one or more holes 18 formed through each side end (i.e., left-side end and the right-side end) of the rear support member 14B as may be seen in FIG. 5. In accordance with one embodiment, a pair of holes 18 may be formed through each side end (i.e., left-side end and the right-side end) of the rear support member 14B. The pair of holes 18 maybe aligned vertically on each side end (i.e., left-side end and the right-side end) of the front support member 14A.

One of the pair of side support members 14C and 14D may be coupled to each side end of the rear support member 14B. In accordance with one embodiment, each of the pair of side support members 14C and 14D may attached to the rear support member 14A inside of where the holes 18 may be formed through each side end (i.e., left-side end and the right-side end) of the rear support member 14B.

Additional support members may be attached to the front support member 14A and the rear support member 14B. These additional support members may be positioned in-between the pair of side support members 14C and 14D coupled to each side end of the front support member 14A and rear support member 14B. Alternatively, or in addition to, netting or other mesh type materials may be positioned on top of the frame 14.

Adjacent modules 12 may share a common front leg 20. As may be seen in FIG. 4, a common front leg 20 may be shared by the front support member 14A of the frames 14 of two adjoining modules 12. The common front leg 20 may be positioned at an intersection of two contiguous frames 14. Holes 22 may be formed in a top area of the common front leg 20. The holes 22 may be used to secure the front support member 14A of the two adjacent frames 14 to the common front leg 20. In accordance with on be embodiment, a pair of holes 22 may be formed on each side edge (left side and right side) of the top area of the common front leg 20. The pair of holes 22 on each side edge (left side and right side) of the top area of the common front leg 20 may be vertically aligned.

A notch platform 24 may be formed in the top area of the common front leg 20. The holes 22 may be formed in a vertical surface 24A of the notch platform 24. In accordance with one embodiment, the holes 22 may be formed on each side edge (left side and right side) of the vertical surface 24A of the notch platform 24. The pair of holes 22 formed in the vertical surface 24A of the notch platform 24 may be vertically aligned.

When securing adjacent modules 12 to the common front leg 20, the front support member 14A of the frame 14 of each adjacent module 12 may be positioned in and rests on the notched platform 24 formed on the common front leg 20. Connectors 26 may be used to secure the front support member 14A of each adjacent module 12 to the common front leg 20. The connectors 26 may be inserted through each hole 16 formed through each side end (i.e., left-side end and the right-side end) of the front support member 14A and into the corresponding pair of holes 22 formed in the vertical surface 24A of the notch platform 24. In accordance with one embodiment, the connectors 26 may be hex bolts 26A and the holes 22 may be threaded inserts countersunk 22A. Thus, in this embodiment, the hex bolts 26A may be guided through the holes 16 and then fastened into two dedicated and corresponding threaded inserts countersunk 26A in the common front leg 20 for both front support members 14A as may be seen in FIG. 4.

Figure 2:
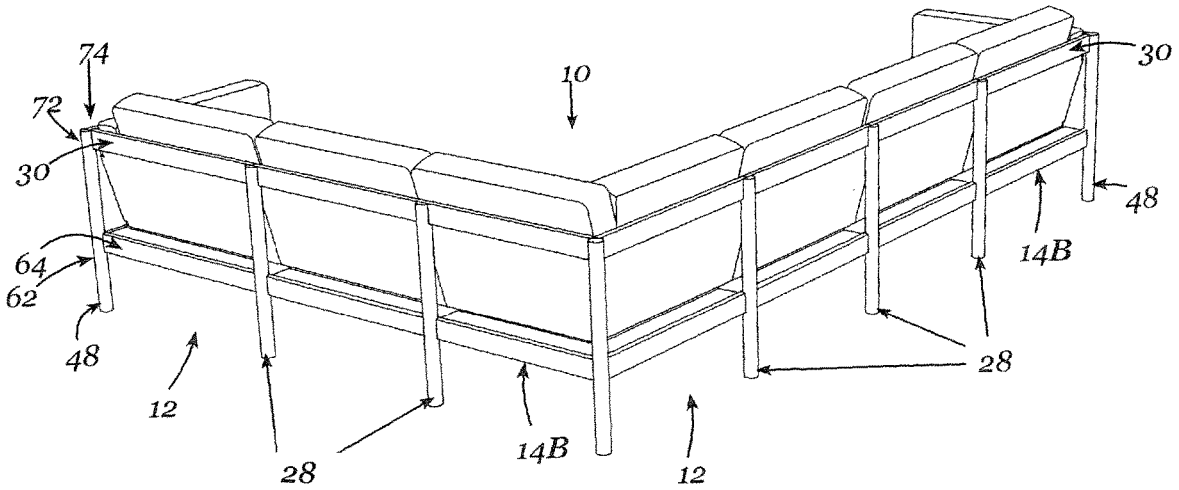
FIG. 2 is a rear perspective view of an exemplary embodiment of the module furniture system of FIG. 1 in accordance with one embodiment of the present invention.
Figure 3:
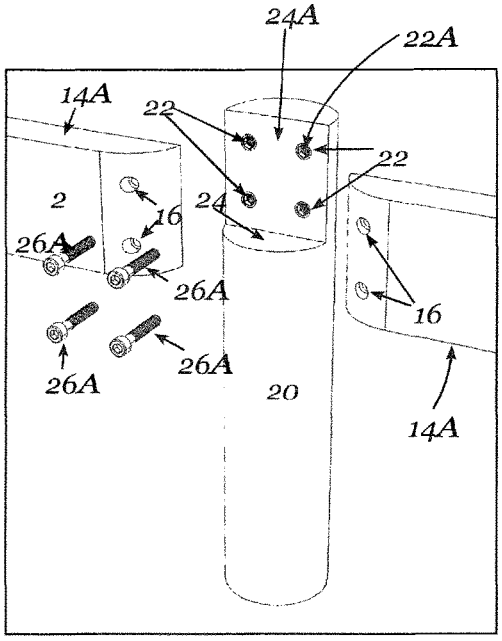
FIG. 3 is a magnified exploded perspective view of an exemplary embodiment of shared common front leg of the module furniture system of FIG. 1 in accordance with one embodiment of the present invention.
Figure 4:
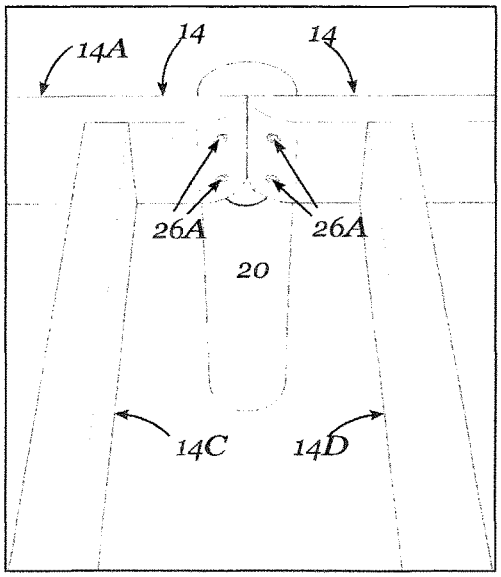
FIG. 4 is a magnified perspective view of an exemplary embodiment of the shared common front leg of the module furniture system of FIG. 1 in accordance with one embodiment of the present invention.

As may be seen in FIGS. 2 and 5, adjacent modules 12 may share a common rear leg 28. As may be seen in FIG. 5, a common rear leg 28 may be shared by the rear support member 14B of the frames 14 of two adjoining modules 12. The common rear leg 28 may also be shared by a back-support member 30 of adjoining modules 12.

The common rear leg 28 may be positioned at an intersection of two contiguous frames 14. Holes 32 may be formed in a lower area of the common rear leg 28. The holes 32 may be used to secure the rear support member 14B of the two adjacent frames 14 to the common rear leg 28. In accordance with on be embodiment, a pair of holes 32 may be formed on each side edge (left side and right side) of the lower area of the common rear leg 28. The pair of holes 32 on each side edge (left side and right side) of the lower area of the common rear leg 28 may be vertically aligned.

A notch platform 34 may be formed in the lower area of the common rear leg 28. The holes 32 may be formed in a vertical surface 34A of the notch platform 34. In accordance with one embodiment, the holes 32 may be fowled on each side edge (left side and right side) of the vertical surface 34A of the notch platform 34. The pair of holes 32 formed in the vertical surface 34A of the notch platform 34 may be vertically aligned.

When securing adjacent modules 12 to the common rear leg 28, the rear support member 14B of the frame 14 of each adjacent module 12 may be positioned in and rests on the notched platform 34 formed on the shared common rear leg 28. Connectors 36 may be used to secure the rear support member 14B of each adjacent module 12 to the shared common shared rear leg 28. The connectors 36 may be inserted through each hole 18 formed through each side end (i.e., left-side end and the right-side end) of the rear support member 14B and into the corresponding pair of holes 32 formed in the vertical surface 34A of the notch platform 34. In accordance with one embodiment, the connectors 36 may be hex bolts 36A and the holes 32 may be threaded inserts countersunk 32A. Thus, in this embodiment, the hex bolts 36A may be guided through the holes 32 and then fastened into two dedicated and corresponding threaded inserts countersunk 36A in the common rear leg 28 for both rear support members 14B as may be seen in FIG. 5.

The common rear leg 28 may also be shared by a back-support member 30 of adjoining modules 12. The back-support member 30 may have one or more holes 38 formed through each side end (i.e., left-side end and the right-side end) of the back-support member 30 as may be seen in FIG. 5. In accordance with one embodiment, a pair of holes 38 may be formed through each side end (i.e., left-side end and the right-side end) of the back-support member 30. The pair of holes 38 maybe aligned vertically side end (i.e., left-side end and the right-side end) of the back-support member 30.

The common rear leg 28 may have holes 40 formed in a top area of the common rear leg 28. The holes 40 may be used to secure the back-support member 30 of the two adjacent frames 14 to the common rear leg 28. In accordance with on be embodiment, a pair of holes 40 may be formed on each side edge (left side and right side) of the top area of the common rear leg 28. The pair of holes 40 on each side edge (left side and right side) of the top area of the common rear leg 28 may be vertically aligned.

A notch platform 42 may be formed in the top area of the common rear leg 28. The holes 40 may be formed in a vertical surface 42A of the notch platform 42. In accordance with one embodiment, the holes 42 may be formed on each side edge (left side and right side) of the vertical surface 42A of the notch platform 42. The pair of holes 40 formed in the vertical surface 42A of the notch platform 42 may be vertically aligned.

The back-support member 30 of each adjacent module 12 may be positioned in and rests on the notched platform 42 formed on the shared common rear leg 28. Connectors 44 may be used to secure the back-support member 30 of each adjacent module 12 to the shared common shared rear leg 28. The connectors 44 may be inserted through each hole 38 formed through each side end (i.e., left-side end and the right-side end) of the back-support member 30 and into the corresponding pair of holes 40 formed in the vertical surface 42A of the notch platform 42. In accordance with one embodiment, the connectors 44 may be hex bolts 44A and the holes 40 may be threaded inserts countersunk 40A. Thus, in this embodiment, the hex bolts 44A may be guided through the holes 38 and then fastened into two dedicated and corresponding threaded inserts countersunk 40A in the common rear leg 28 as may be seen in FIG. 5.

Figure 6:
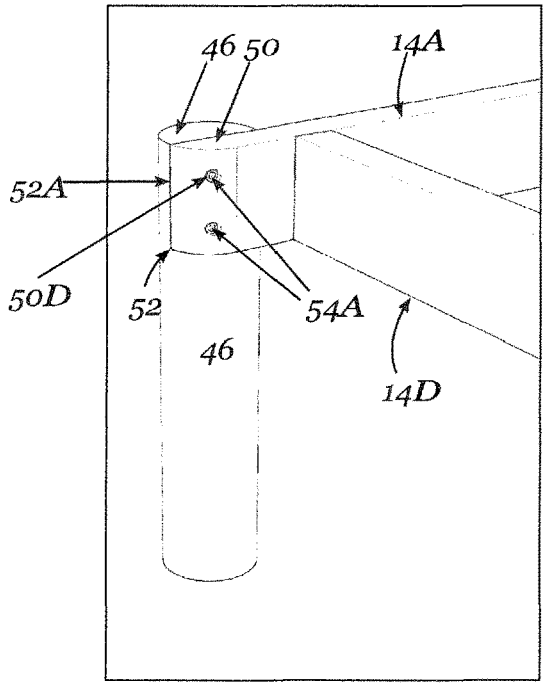
FIG. 6 is a magnified perspective view of an exemplary embodiment of a non-shared common front leg of the module furniture system of FIG. 1 in accordance with one embodiment of the present invention.

As may be seen in FIGS. 1, 2 and 6, the modules 12 located at each end of the configuration formed may have a non-shared front leg 46 and a non-shared rear leg 48. The non-shared front leg 46 may both have holes 50 formed in a top area of the non-shared front leg 46. The holes 50 may be used to secure the front support member 14A of the module 12 to the non-shared front leg 46. In accordance with on be embodiment, a pair of holes 50 may be formed on the top area of the non-shared front leg 46. The pair of holes 50 may be vertically aligned.

A notch platform 52 may be formed in the top area of the non-shared front leg 46. The holes 50 may be formed in a vertical surface 52A of the notch platform 52. In accordance with one embodiment, the pair of holes 50 formed in the vertical surface 52A of the notch platform 52 may be vertically aligned.

When securing the front support member 14A to the non-shared front leg 46, the front support member 14A of the end module 12 may be positioned in and rests on the notched platform 52 formed on the non-shared front leg 46. Connectors 54 may be used to secure the front support member 14A to the non-shared front leg 46. The connectors 54 may be inserted through each hole 16 formed through the desired side end (i.e., left-side end or the right-side end) of the front support member 14A and into the corresponding pair of holes 50 formed in the vertical surface 52A of the notch platform 52. In accordance with one embodiment, the connectors 54 may be hex bolts 54A and the holes 50 may be threaded inserts countersunk 50A. Thus, in this embodiment, the hex bolts 54A may be guided through the holes 50 and then fastened into two dedicated and corresponding threaded inserts countersunk 50A as may be seen in FIG. 6.

The non-shared rear leg 48 may be similar to the common rear leg 28. The non-shared rear leg 48 may have holes formed in a lower area of the non-shared rear leg 48. The holes may be used to secure the rear support member 14B of the end module 12 to the non-shared rear leg 48. In accordance with on be embodiment, a pair of holes may be formed on the lower area of the non-shared rear leg 48. The pair of holes may be vertically aligned.

A notch platform 62 may be formed in the bottom area of the non-shared rear leg 48. The holes may be formed in a vertical surface of the notch platform 62. In accordance with one embodiment, the pair of holes formed in the vertical surface of the notch platform 62 may be vertically aligned.

When securing the rear support member 14B to the non-shared rear leg 48, the rear support member 14B of the end module 12 may be positioned in and rests on the notched platform 62 formed on the non-shared rear leg 48. Connectors 64 may be used to secure the rear support member 14B to the non-shared rear leg 48. The connectors 64 may be inserted through each hole 18 formed through the desired side end (i.e., left-side end or the right-side end) of the rear support member 14B and into the corresponding pair of holes formed in the vertical surface of the notch platform 62. In accordance with one embodiment, the connectors 64 may be hex bolts and the holes may be threaded inserts countersunk. Thus, in this embodiment, the hex bolts may be guided through the holes 18 and then fastened into two dedicated and corresponding threaded inserts countersunk as may be seen in FIG. 1.

The non-shared rear leg 48 may both have holes formed in an upper area of the non-shared rear leg 48. The holes may be used to secure the back-support member 30 of the end module 12 to the non-shared rear leg 48. In accordance with on be embodiment, a pair of holes may be formed on the upper area of the non-shared rear leg 48. The pair of holes may be vertically aligned.

A notch platform 72 may be formed in the bottom area of the non-shared rear leg 48. The holes may be formed in a vertical surface of the notch platform 72. In accordance with one embodiment, the pair of holes formed in the vertical surface of the notch platform 72 may be vertically aligned.

When securing the back-support member 30 to the non-shared rear leg 48, the back-support member 30 of the end module 12 may be positioned in and rests on the notched platform 72 formed on the non-shared rear leg 48. Connectors 74 may be used to secure the back-support member 30 to the non-shared rear leg 48.

The connectors 74 may be inserted through each hole 38 formed through the desired side end (i.e., left-side end or the right-side end) of the back-support member 30 and into the corresponding pair of holes formed in the vertical surface of the notch platform 72. In accordance with one embodiment, the connectors 74 may be hex bolts and the holes may be threaded inserts countersunk. Thus, in this embodiment, the hex bolts may be guided through the holes 38 and then fastened into two dedicated and corresponding threaded inserts countersunk as may be seen in FIG. 1.

The "L" shaped couch 10 may be constructed so that the end modules 12 may be "armed module," constructed with a dedicated armrest 80 build for either a left end module 12A or a right end module 12B. If desired, the customer can opt instead to terminate one or both ends with an "armless module" as shown as modules 12C. The non-shared front leg 46 and a non-shared rear leg 48 may be used in a similar manner as described above to secure the armrest 80 thereto.

Seat cushions 45 may be placed on the frame 14 of each module 12. Back cushions 47 may be placed on the frame 14 and against the back-support member 30 of each module 12.

Figure 7:
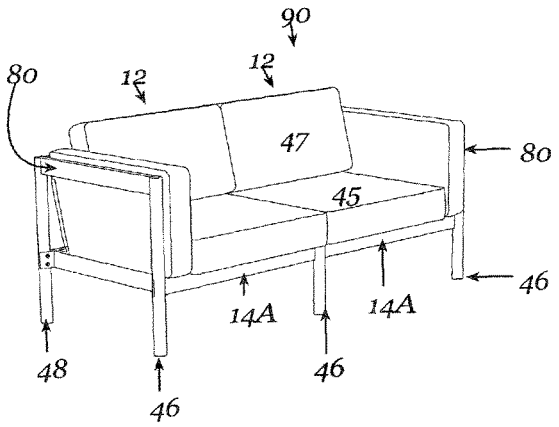
FIG. 7 is a front perspective view of an exemplary embodiment of a module furniture system in accordance with one embodiment of the present invention.
Figure 8:
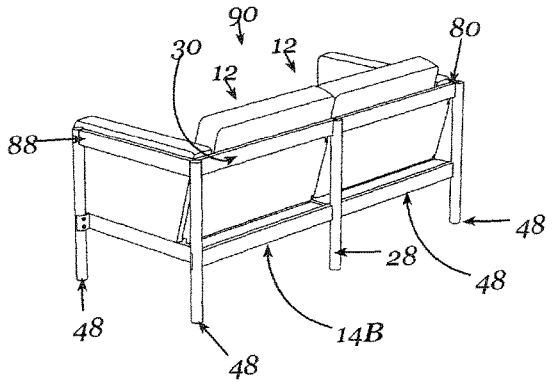
FIG. 8 is a rear perspective view of an exemplary embodiment of the module furniture system of FIG. 7 in accordance with one embodiment of the present invention.

The shared-leg module furniture system created opportunities to build countless configurations. As may be shown in FIGS. 7-8, the shared-leg module furniture system may be sued to form a "Loveseat" 90. The "Loveseat" 90 may utilize a single common front leg 20, a single common rear leg 28, and two modules 12.

Figure 9:
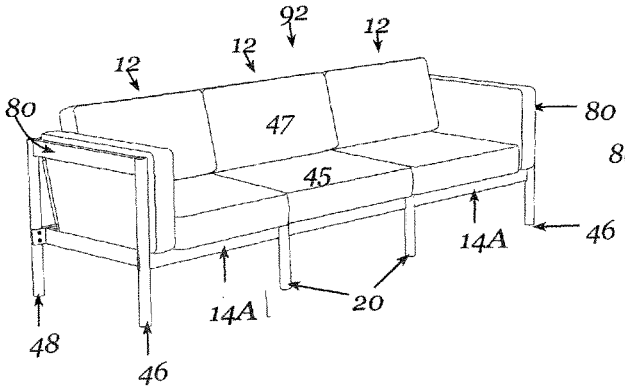
FIG. 9 is a front perspective view of an exemplary embodiment of a module furniture system in accordance with one embodiment of the present invention.
Figure 10:
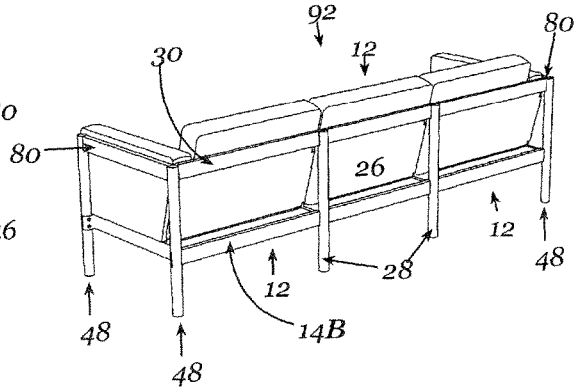
FIG. 10 is a rear perspective view of an exemplary embodiment of the module furniture system of FIG. 9 in accordance with one embodiment of the present invention.

As may be shown in FIGS. 9-10, the shared-leg module furniture system may be used to create a couch 92. The couch 92 may be formed of three modules 12, a pair of common front legs 20, and a pair of common rear legs 28.

The foregoing description is illustrative of particular embodiments of the application, but is not meant to be a limitation upon the practice thereof. The following claims, including all equivalents thereof, are intended to define the scope of the application.

What is claimed is:

1. A modular furniture system, comprising:
a first modular furniture unit, comprising:
a first frame;
a first front leg attached to the first frame;
a first rear leg attached to the first frame;
a second front leg attached to the first frame;
a second rear leg attached to the first frame;
a first back support member attached to the first rear leg and the second rear leg; and
a first arm rest attached to the first front leg and the first rear leg;
a second modular furniture unit, comprising:
a second frame attached to the second front leg and the second rear leg;
a third front leg attached to the second frame and to one of a second arm rest or a third frame of a third modular furniture unit; and
a third rear leg attached to one of a second arm rest or a third frame of a third modular furniture unit.

2. The modular furniture system of claim 1, comprising a second back support member attached to the second rear leg and the third rear leg.

3. The modular furniture system of claim 1, wherein the third front leg and the third rear leg are directly attached to the second arm rest.

4. The modular furniture system of claim 1, comprising:
a fourth front leg attached to a third frame of the third modular furniture unit and to the second arm rest; and
a fourth rear leg attached to the third frame and to the second arm rest.

5. The modular furniture system of claim 4, comprising a third back support member coupled to the fourth front leg and the fourth rear leg.

6. A modular furniture system, comprising:
a first modular furniture unit, comprising:
a first frame;
a first front leg attached to the first frame;
a second front leg attached to the first frame;
a first rear leg attached to the first frame; and
a second rear leg attached to the first frame
a second modular furniture unit, comprising:
a second frame;
a third front leg attached to the second frame; and
a third rear leg attached to the second frame;
wherein the second front leg and the second rear leg are both attached to the second frame and support and hold both the first frame and the second frame, wherein the first front leg, the second front leg and the third front leg each comprises:
a leg member;
a notch formed in a lower area of the leg member;
a first set of holes formed on a first side of the notch; and
a second set of holes formed on a second side of the notch, wherein the first side and the second side are on opposing sides of the notch.

7. The modular furniture system of claim 6, comprising a first back support member coupled to the first rear leg and the second rear leg.

8. The modular furniture unit of claim 7, comprising a second back support member coupled to the second rear leg and the third rear leg.

9. The modular furniture unit of claim 6, wherein the first front leg and the first rear leg are attached to a first arm rest.

10. The modular furniture unit of claim 6, wherein the third front leg and the third rear leg are attached to a second arm rest.

11. The modular furniture unit of claim 6, comprising:
a third modular furniture unit, comprising:
a third frame;
a fourth front leg attached to the third frame; and
a fourth rear leg attached to the third frame;
wherein the third front leg and the third rear leg support and hold both the second frame and the third frame.

12. The modular furniture unit of claim 11, comprising a third back support member coupled to the third rear leg and the fourth rear leg.

13. The modular furniture unit of claim 6, wherein the first rear leg, the second rear leg and the third rear leg each comprises:
a rear leg member;
a first notch formed in a lower area of the rear leg member;
a first set of holes formed on a first side of the first notch;
a second set of holes formed on a second side of the first notch, wherein the first side and the second side are on opposing sides of the notch;
a second notch formed in an upper area of the rear leg member;
a third set of holes formed on a first side of the second notch; and
a fourth set of holes formed on a second side of the second notch, wherein the first side and the second side are on opposing sides of the second notch.

* * * * *